US005778471A

United States Patent [19]

Collison

[11] Patent Number: 5,778,471

[45] Date of Patent: Jul. 14, 1998

[54] EMERGENCY WATER STORAGE DEVICE

[76] Inventor: Timothy J. Collison, 2317 W. Chandler Ave., Santa Ana, Calif. 92704

[21] Appl. No.: 747,796

[22] Filed: Nov. 14, 1996

[51] Int. Cl.[6] ..... D06F 39/08; F03B 11/00

[52] U.S. Cl. ..... 8/158; 68/207; 68/3 R; 137/590; 137/899; 137/359

[58] Field of Search ..... 68/3 R, 207, 902, 68/208, 17 R; 8/158; 137/590, 899, 359, 592, 599

[56] References Cited

U.S. PATENT DOCUMENTS

| | | | |
|---|---|---|---|
| 2,588,774 | 3/1952 | Smith | 68/902 |
| 2,931,382 | 4/1960 | Cirillo | 137/357 |
| 3,020,741 | 2/1962 | Waldrop | 68/207 |
| 3,095,893 | 7/1963 | Martin | 137/216 |
| 3,102,799 | 9/1963 | Kiekhaefer | 137/593 |
| 3,976,228 | 8/1976 | Robbins | 222/143 |
| 4,718,452 | 1/1988 | Maitland | 137/592 |
| 4,962,789 | 10/1990 | Benscoter | 137/571 |
| 5,029,612 | 7/1991 | Simbulan | 137/592 |
| 5,046,529 | 9/1991 | Corella | 137/590 |
| 5,241,843 | 9/1993 | Hein | 68/3 R |
| 5,307,650 | 5/1994 | Mertz | 68/207 |
| 5,431,032 | 7/1995 | Oberg | 68/207 |
| 5,606,878 | 3/1997 | Arreghini et al. | 68/902 |
| 5,617,885 | 4/1997 | Centis | 68/902 |

*Primary Examiner*—Amy B. Vanatta
*Attorney, Agent, or Firm*—Terry L. Miller

[57] ABSTRACT

A device for storing a supply of emergency potable water includes a tank member which is especially configured to store unobtrusively in the home. The tank member is configured to connect into the domestic fresh cold water supply to an automatic clothes washer, and to sit alongside of the clothes washer, possibly in a gap defined between this washing machine and an adjacent clothes dryer machine. The tank member is configured to insure that a circulation of water occurs each time the washing machine draws fresh cold water during operation to wash clothing, and to insure that sediment does not collect in the tank member. Thus, a self-refreshing supply of potable water is provided which is of no significant inconvenience to store in the home. Further, the tank member, or a tray-like member nested atop this tank member, is configured to form a convenient adjunct and continuation of horizontal utility surfaces provided commonly at the top of clothes washers and dryers. A version of the tank member is can also be provided with temporary wheels allowing it to be tipped and rolled about for dispensing of the stored water, if desired.

20 Claims, 2 Drawing Sheets

EMERGENCY WATER STORAGE DEVICE

BACKGROUND OF THE INVENTION

1. Field of the Invention

The present invention is in the field of water storage devices. More particularly, the present invention relates to devices of the type used to store a supply of emergency potable water in or around a dwelling, such as a home or apartment. Still more particularly, the present invention provides such an emergency water storage device which is unobtrusively stored in the dwelling, is self-refreshing so that the stored water does not become stagnant, is easily transported by hand, is rugged and inexpensive to manufacture, which according to one embodiment provides a utility surface usable in the dwelling, and which according to another embodiment allows multiples of the device to be stacked securely together for storage or dispensing of larger supplies of water.

2. Related Technology

The provision of an accessible emergency supply of potable water in or close to the dwelling is a problem faced by many people around the world. For example, in the United States and in other countries, those who live in areas which may experience natural disasters such as earthquakes, tornadoes, or flooding may want to provide a supply of potable water sufficient to provide several days of a family's needs to be stored at the home and to be easily available to the family after such a natural disaster. However, all of the conventional expedients for storing such an emergency water supply around the home have one or several disadvantages. One conventional expedient which is recommended by emergency-preparedness officials, is to use a 55-gallon plastic barrel, and to fill this barrel with tap water along with a quantity of liquid chlorine bleach sufficient to prevent algae and bacteria growth. According to this plan, this water barrel can be stored outside, for example, in a convenient corner of the yard or alongside a garage. This supply of water will remain usable for a couple years before it needs to be renewed. When the barrel needs to be renewed, it has to be emptied of old water and washed out. The barrel must be very thoroughly rinsed to prevent carrying over soap or detergent residue into the next batch of water to be stored.

Most people are somewhat hesitant to drink water containing as much chlorine as is required to keep tap water for a year or more. And, the thought of drinking chlorine water that could be a year or two old and still might have some algae or bacteria in it doesn't appeal to many people. Thus, very few people indeed actually use this method of storing emergency water.

An alternative, is to simply store a supply of bottled water, or drinking water in jugs. These bottles or jugs can be kept in the garage or a closet of the home, for example. Although this expedient takes up quite a bit of storage space around a home or apartment if an adequate supply of water is to be stored, it has the advantage that many people like to drink bottled water rather than tap water anyway. However, such bottled drinking water contains no chlorine to prevent bacteria or algae growth, and the stored stock of water must be rotated as it is used in order to assure that the stock has the longest shelf life possible. Alternatively, bottled or jug water should be discarded and replaced after it is sufficiently old. A common consequence is that people who think they are using this method actually are storing far too little water for emergency uses, or that the stored water is at least in part so old because of lack of proper rotation of stock that it should not be used.

Other alternatives of more elaborate nature are presented in U.S. Pat. Nos. 3,095,893, issued 2 Jul. 1963 to J. Martin; 3,976,228, issued 24 Aug. 1976 to A. B. Robbins; 4,718,452, issued 12 Jan. 1988 to D.W. Maitland; 4,962,789, issued 16 Oct. 1990 to K. B. Benscoter; 5,029,612, issued 9 Jul. 1991, to V. M. Simbulan; and 5,046,529, issued 10 Sep. 1991 to A. P. Corella. Each of these patents presents a teaching which may be considered to be relevant to the present invention. However, each of these teachings is also believed to be subject to one or more serious deficiencies. For example, U.S. Pat. Nos. 4,718,452; 4,962,789; 5,029,612; and 5,046,529, all present barrel-like or tank-like structures which are supposed to be stored in or around the home. However, these conventional water storage structures simply are too obtrusive and inconvenient to have received any significant acceptance by the public. The other two patents listed above present water storage devices which are far too complex or too inconvenient to have received any public acceptance at all, so far as is known to the Applicant.

SUMMARY OF THE INVENTION

In view of the above, it is an object for this invention to avoid one or more of the shortcomings of the conventional emergency water storage expedients.

Further, it is an object for this invention to provide a device for storing an emergency supply of water in the dwelling, which is unobtrusive.

It is another object for this invention to provide a device for storing an emergency supply of water in the dwelling, which self-refreshes the emergency water supply and does not allow the stored water to stagnate.

Another object for the present invention is to provide such an emergency water storage device for use in the dwelling in which the device advantageously provides also an extension of utility surfaces commonly existing in the home laundry area.

In view of the above, the present invention provides a device for storing an emergency supply of fresh water in the dwelling while also providing an adjunct to a horizontal utility surface provided at the top of an automatic washing machine, the device comprising: a tank member configured to have the form of a thin upright prismatic body defining a chamber therein for holding a supply of fresh water, the tank member including a generally horizontal top wall portion inwardly bounding the chamber and outwardly defining an upper surface oriented to provide a continuation of the top surface of the washing machine when the tank member is located along side of the washing machine, the tank member including inflow and outflow means for allowing fresh domestic water to flow from a supply thereof into the tank member chamber and from the tank member chamber to the washing machine; the tank member defining also a bottom wall portion, a front wall portion, a rear wall portion, and a pair of opposite side wall portions all cooperatively bounding the chamber; each of the pair of side wall portions being of an area much greater than any other wall portion, and at least one reinforcement bridging the chamber and extending between the side wall portions, the reinforcement being stressed in tension by water pressure within the tank portion and supporting the opposite side wall portions against bulging.

According to another aspect, the present invention provides a method of unobtrusively storing an emergency supply of fresh water in a dwelling, the method comprising steps of: providing a tank member configured to have the form of a thin upright prismatic body defining a chamber therein for holding a supply of fresh water, providing the tank member with inflow and outflow means for allowing fresh domestic water to flow from a supply thereof into the tank member chamber and from the tank member chamber to a washing machine; providing the tank member also with a bottom wall portion, a front wall portion, a rear wall portion, and a pair of opposite side wall portions all cooperatively bounding the chamber; configuring each of the pair of side wall portions to be of an area much greater than any other wall portion, and providing at least one reinforcement bridging the chamber and extending between the side wall portions, stressing the at least one reinforcement in tension by water pressure within the tank portion, and supporting the opposite side wall portions against bulging with the at least one reinforcement.

An advantage of the present invention derives from its extremely unobtrusive storage of water in the domestic environment. That is, the device allows storage of an emergency supply of water which is self-refreshing, and which is conveniently located adjacent to the automatic washing machine in the laundry area of a typical dwelling. The emergency water storage device may set beside or behind the automatic washing machine, and will only take up space that is usually wasted space in the laundry area.

In its location next to the automatic washing machine of a laundry area, the emergency water storage device of the present invention forms part of the fresh cold water flow path to the washing machine. Accordingly, each time a load of laundry is done in the washing machine, the stored water supply is partially or totally refreshed. In this way, the stored water supply is never allowed to become stagnant.

Further, when use of the emergency water supply is required, the device provides convenient handles to allow the tank portion of the device to be moved for dispensing the stored fresh water. An alternative and optional version of the device allows the tank portion to be tipped and rolled about by the addition of a bushing and axle kit carrying a pair of spaced apart wheels. Because the wheels are sufficiently spaced apart, the tank portion will also stand upright on its own even when removed from its storage location.

An embodiment of the present emergency water storage device has the advantage of effectively extending the adjacent utility surfaces of a washer and dryer machine. That is, an upper wall of the storage tank portion of the device is arranged to be approximately level with the adjacent top surfaces of the washer and dryer. In this way, the utility surfaces provided by these machines are effectively extended across the gap normally existing between the machines.

An additional advantage of the present emergency water storage device is provided by an alternative including an auxiliary tray-like structure which nests atop the storage tank portion, spans the space between adjacent washer and dryer machines, and provides an extension of the top surfaces of these adjacent machines with essentially no gap to interrupt this utility surface. Thus, the utility surfaces provided by these machines in a laundry area is extended and made more useful by this alternative embodiment of the present emergency water storage device.

A better understanding of the present invention will be obtained from reading the following description of several alternative exemplary preferred embodiments of the present invention when taken in conjunction with the appended drawing Figures. In these drawing Figures the same features (or features analogous in structure or function) are indicated with the same reference numeral throughout the several views. It will be understood that the appended drawing Figures and description here following relate only to one or more exemplary preferred embodiments of the invention, and as such, are not to be taken as implying a limitation on the invention. No such limitation on the invention is implied, and none is to be inferred.

BRIEF DESCRIPTION OF THE DRAWING FIGURES

FIG. 1 provides an isolated perspective view of exemplary washer and dryer machines in a laundry area of a dwelling, and of an emergency water storage device embodying the present invention unobtrusively stored in an operative location in between the machines;

FIG. 2 provides a perspective view of a tank portion and part of the interconnecting hoses of the emergency water storage device according to a slightly different alternative embodiment of the device, and is seen from a perspective opposite to that of FIG. 1 and without the adjacent washer and dryer machines. FIG. 2 also diagrammatically illustrates the addition of an optional axle, bushing, and wheel kit to the water storage tank portion to allow it to be tipped and rolled;

FIG. 3 is a fragmentary cross sectional elevation view taken at line 3—3 of FIG. 1, and the general alignment of this section is also shown on the alternative tank portion of FIG. 2 at line 3—3;

FIG. 4 provides a cross sectional side elevation view taken at line 4—4 of FIG. 2;

FIG. 5 provides a fragmentary cross sectional elevation view taken at line 5—5 of FIG. 2;

FIG. 6 is an enlargement of an encircled portion of FIG. 4 and provides a fragmentary cross sectional side elevation view of operative valve parts of the device, along with associated portions of the tank portion;

FIG. 7 provides a fragmentary cross sectional elevation view taken at line 7—7 of FIG. 2; and FIG. 8 is a fragmentary cross sectional elevation view showing two nested tank portions according to another alternative embodiment of the device, and the view of each of these tank portions is analogous to full cross sectional view like those that would be obtained if sections were taken at either line 5—5 or 7—7 in the embodiment of FIG. 2.

DETAILED DESCRIPTION OF EXEMPLARY PREFERRED EMBODIMENTS OF THE INVENTION

Figure 1:
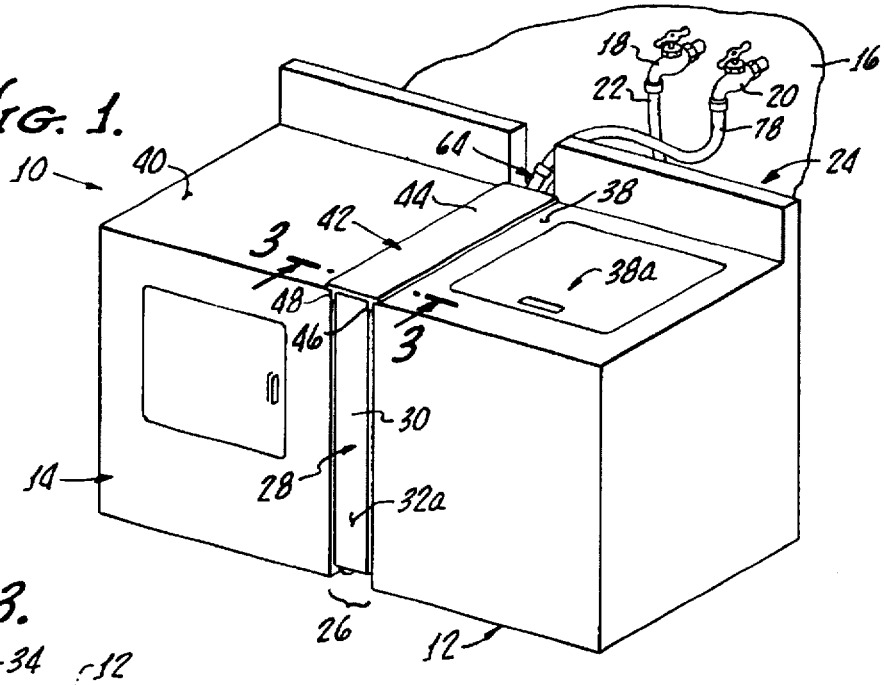

Considering first FIG. 1, a laundry area of a dwelling (i.e., of an apartment or house, for example) is shown in fragmentary perspective view, and is generally indicated with the numeral 10. This laundry area 10 may, for example, be located in a variety of areas in or adjacent to the dwelling. The laundry area 10 may be located in a laundry room of the dwelling, in an attached or detached garage, in a basement, in a laundry closet, or in other such arrangements which are commonly provided in association with dwellings for allowing an automatic washing machine 12 and/or automatic dryer 14 to be available for use by the occupants of the dwelling. In this particular laundry area 10, a wall 16 carries a hot water spigot 18 and a cold water spigot 20. From the hot water spigot 18, a hose 22 extends to a hot water fitting (not shown) on the back of the washing machine 12. The hose 22 extends behind the washing machine 12 in a space 24 defined between the back of the machine 12 and the adjacent wall 16. This space 24 is commonly at least about 6 to 8 inches deep because of the location behind the adjacent dryer 14 of a flexible duct (not shown) conventionally used to connect the air outlet of the dryer to the stub of an exhaust duct (also not shown). Because it is conventional to align the washer and dryer with the fronts of these machines even with one another, the necessary space behind the dryer means that there is a similar space behind the washer 12. The hose 22 uses only a small part of this available space, and the significance of this unused space behind the washer 12 will be further explained below.

It will also be noted that in this instance the washer and dryer machines 12 and 14 are spaced laterally apart, so that a gap 26 is present between the machines. It is conventional for this gap 26 to be part of a "shaking space" of at least a couple of inches in all directions around the washing machine 12. This shaking space is necessary because the washing machine will shake or move about a little during the extract or spin cycle even with an acceptably balanced load of clothing being washed in the machine. Further, in the event of a severely unbalanced load, the washing machine may shake quite violently through one or a few excursions before the unbalance switch shuts the machine off. Ordinarily, it is desired that the washing machine 12 not contact other solid structures during this unbalanced shaking because of the objectionable noise such contact produces.

It will be further understood that depending on the amount of space provided in the laundry area, the gap 26 may be only 3 or 4 inches. On the other hand, in the case where the machines 12 and 14 are housed in a garage or basement laundry area, for example, it is not uncommon for the machines not to be laterally constrained by other closely-located structures. In such an instance, the gap 26 may possibly be quite wide (i.e., as much as a foot or more).

Returning to further consideration of FIG. 1, it is seen that between the machines 12 and 14 in the gap 26 is disposed a water storage device 28 embodying the present invention. Viewing FIG. 1, it will be appreciated that the device 28 includes a tank member 30 which rests on the floor along with the washer and dryer machines and is only a few inches wide, but which has a height and a depth like that of the washer and dryer in side elevation view. In other words, the tank member 30 is configured as a thin upright prismatic body, defining a chamber for holding water therein. As will be seen, the tanks 30 may be made in a variety of volume capacities by varying the thickness of the tank in the direction of the width of gap 26. For one example, the tank member 30 may be about 36 inches high and about 26 inches deep from front to back. The thickness and water storage volume of the tank member 30 will be given further consideration below. For the present, it is sufficient to note that the tank member 30 is from about 2 inches thick to as much as about 10 inches or more in thickness.

Figure 4:
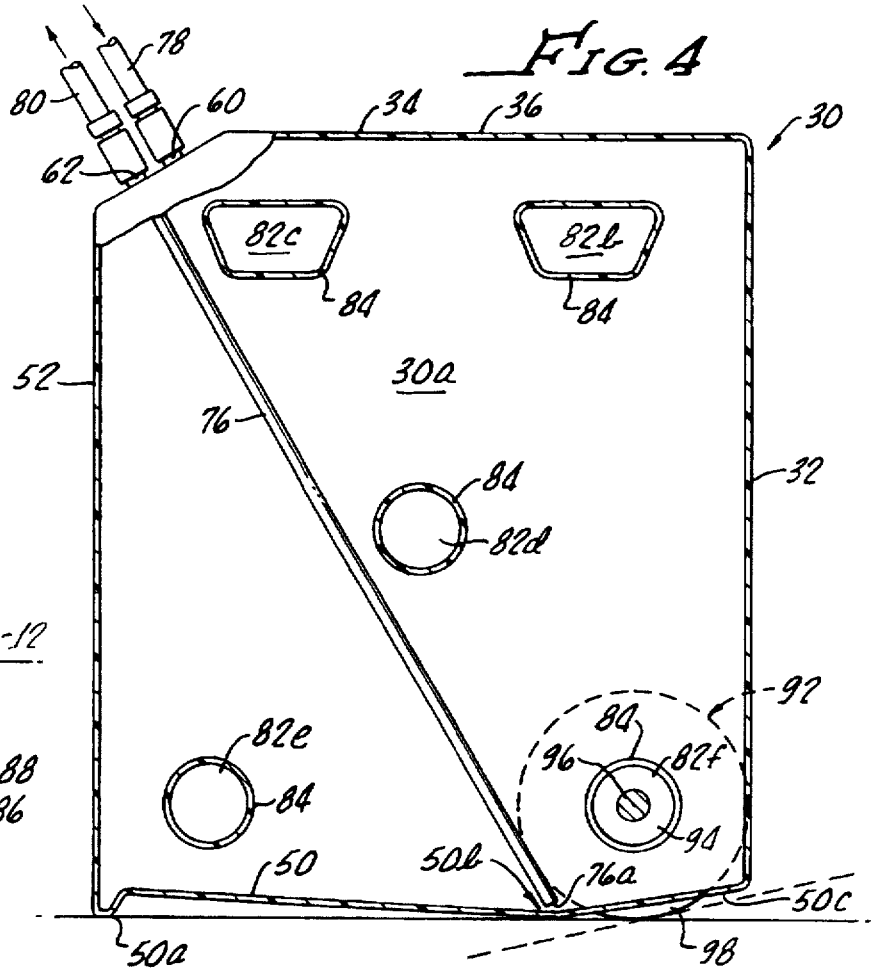

The tank member 30 has a front wall 32, the front surface 32*a* of which is generally even with those of the machines 12 and 14. This tank member 30 also has a top wall 34 (best seen in FIGS. 2 and 4, which at a top surface 36 is generally even with adjacent top surfaces 38 and 40 of the washer and dryer machines 12 and 14. It is seen in this instance that the top surface 38 of the washing machine 12 is in part defined by a lid 38*a*. The top surfaces 38 and 40 of the washer and dryer machines are sometimes hereinafter referred to as utility surfaces because these surfaces are commonly used to conveniently store laundry supplies for immediate use, or as laundry folding surfaces, for example.

In the conventional laundry area, the utility surfaces of the washer and dryer machines are interrupted by gap 26. However in this case, the device 28 includes a tray-like member 42 which spans the gap 26 and provides a top surface 44 forming a continuation of and connecting the surfaces 38 and 40. The tray-like member 42 is preferably formed of shape-retaining but somewhat yieldable material, such as a shape-retaining yieldable polymer (i.e., plastic), and includes a pair of spaced apart ribs 46 and 48 extending alongside of the tank member 30 to space this tank member slightly from the adjacent washer and dryer. Because the tray-like member 42 is somewhat yieldable, and because the tank member 30 is also somewhat yieldable (as will be seen), the "shaking space" around the washing machine 12 will be adequate despite the presence of the tank member 30 and member 42 in the gap 26.

Viewing now FIGS. 1, 2, 3, and 4 in conjunction, the tank member 30 is seen to have also a bottom wall 50, a rear wall 52, and a pair of opposite side walls 54 and 56. The bottom wall 50 includes a foot portion 50*a*, which is effective to slightly elevate the rear of this bottom wall portion. The pair of side walls 54 and 56 are easily seen to be of far greater area than any of the other walls of the tank member 30. As will be seen, provision is make to support these walls 54 and 56 against internal water pressure. A truncated wall portion 58 of the tank member 30 forms a connection between the top wall 34 and rear wall 52. Integrally defined on this wall portion 58 is a pair of externally threaded nipples 60 and 62. Threadably attached to each one of the nipples 60 and 62 is a respective one of a pair of check valve assemblies 64 and 66. Each of these check valve assemblies 64 and 66 includes a respective check valve ball member 68 and a respective spring 70 biasing the valve member 68 to a closed position against a valve seat 72. Thus, it is seen that the check valve assembly 64 provides for flow only toward the tank member 30, while the check valve assembly 66 provides for flow only out of tank member 30. Sandwiched between the nipple 62 and the check valve assembly 66 is a flange portion 74 of a tube member 76. This tube member 76 extends internally of the tank member 30 from nipple 66 to an opening 76*a* located in a basin 50*b* formed by the bottom wall 50. Basin 50*b* is formed by the forwardly sloping portion of bottom wall 50 (elevated at the rear by foot portion 50*a*), and an forwardly sloping up-curved part 50*c* of the bottom wall 50.

Still viewing FIG. 1, it is seen that a hose 78 extends from cold water spigot 20 to the check valve assembly 64. A second hose 80 extends from the other check valve assembly 66 to the cold water fitting (not shown) on the back of washing machine 12. Accordingly, as is indicated by the flow arrows on the drawing Figures, cold water from the spigot 20 flows via hose 78 to check valve assembly 64 and into a chamber 30*a* defined within the tank member 30. Water in the chamber 30*a* flows from the tank member via check valve assembly 66 through hose 80 to the washing machine 12. Each time the washing machine is used, at least some of the water the machine uses will be cold water, and this water will flow through chamber 30*a* of tank member 30. Because the water flow from tank member 30 is collected at basin 50*b* at the opening 76*a* of tube member 76, the water in tank member 30 is refreshed each time the washing machine 12 is used.

Preferably, the tank member 30 is formed of blow-molded polymer. For example, a food-grade of polyethylene resin may be used to blow mold tank member 30. Alternatively, the tank member may be formed of metal, for example, of stainless steel. Viewing FIGS. 2, 4, 5, and 7, it is seen that the tank member 30 includes several reinforcements (each generally indicated with the numeral 82—with each reference also having an alphabetic suffix to distinguish between recesses) which bridge the chamber 30*a*, to extend between the walls 54 and 56. Each reinforcement 82 forms a corresponding recess 82*a* on the exterior of the tank member 30. As can be seen the top two reinforcements (referenced with numerals 82*b* and 82*c*) are generally trapezoidal in shape in side elevation view of the tank member 30. It will be understood that the trapezoidal shape of the reinforcements 82*b* and 82*c* are exemplary only, and that other shapes will serve as well to allow manual purchase on the tank member 30. For example, the top reinforcements, or at least the forward one of these top reinforcements, could be oval, a round shape sufficient in size to allow manual grasping, a triangular shape, or any other shape selected to allow manual grasping of the tank member at this location. Three other reinforcements 82*d*, 82*e* and 82*f* are generally round in shape when seen in side elevation view.

Figure 3:
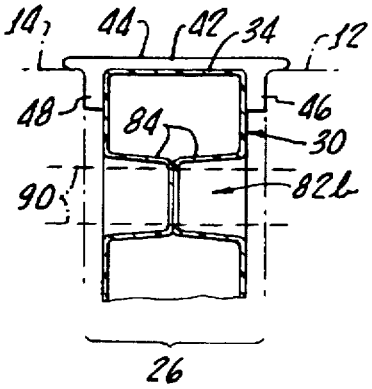
Figure 7:
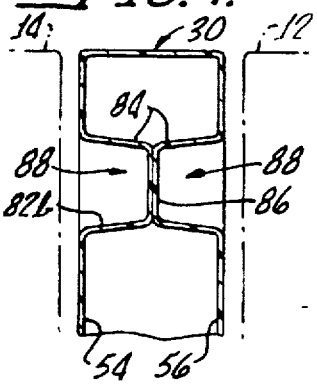
Figure 5:
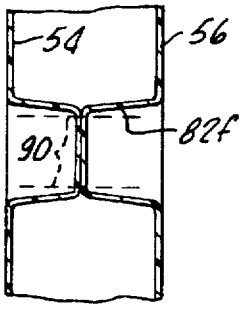
Figure 6:
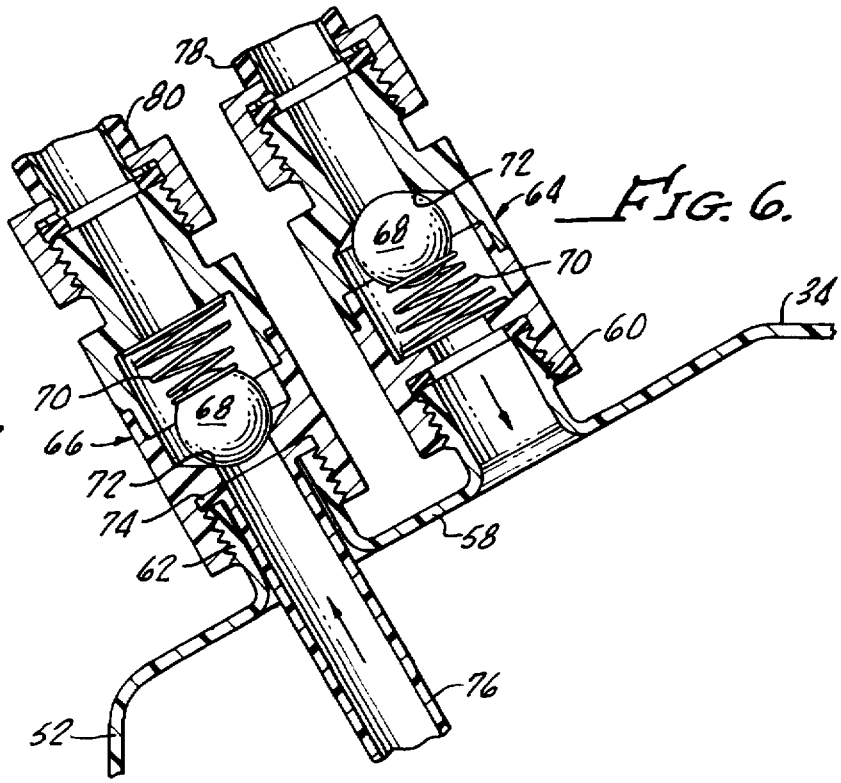

As FIGS. 3, 5, and 7 show, the reinforcements 82 may be formed by an inwardly extending wall portion 84 extending to a partition portion 86. As will be appreciated by those ordinarily skilled in the art of blow molding, the wall portions 84 and partition portions 86 will be formed by forcing parts of the side walls 54 and 56 inwardly while partially molten during the blow molding process, as is indicated by the arrows 88, so that the opposite parts of the side walls 54 and 56 contact and bond to one another to form the partition portions 86. These wall portions contact one another at a line indicated with the numeral 86*a* and bond integrally together because the material of the tank member 30 is at the time at least partially molten. The recesses 82*b* and 82*c* are especially configured to allow the tank member 30 to be manually grasp and lifted at these recesses 82*a*. At FIG. 3 it is seen that the partition portion 86 optionally is cut out at the dotted lines 90 so that the reinforcement recess 82*a* is extended as an aperture completely through the tank member 30. In such a case, the partition portion 86 still includes a sealingly continuous portion 86*b* circumscribing the recess 82*a*. FIG. 5 at lines 90 also indicates that the partition portion 86 may be cut out if desired to provide a similar recess (round in side elevation view in this case) extending as an aperture through the tank member 30, for a purpose to be discussed below. FIG. 7 shows that the recesses 82*a* may alternatively include a solid continuous partition portion 86, while still allowing the tank member 30 to be manually lifted and manipulated using these recesses 82*a* to gain purchase on the tank member 30.

Alternatively, when the tank member 30 is formed of metal, the recesses may be formed of tubular members welded into the side walls of the tank member. Still alternatively, the side walls of such a metallic tank member may be stamped to provide the recesses 82*a*, and may be spot welded together at these recesses to provide the necessary support for the side walls 54 and 56.

Having observed the structure of the device 28, is apparent that regardless of whether the tank member 30 is fabricated of plastic or metal, the reinforcements 82 are stressed in tension to provide support for the side walls 54 and 56 to resist outward bulging caused by interior water pressure. Thus, in use of the device 28 it will be appreciated that the side walls 54 and 56 may be about 3 foot high by about 2 foot from front to back (i.e., about 6 square feet, 864 square inches), so that a typical domestic water supply pressure of about 65 pounds per square inch (for example) will result in a force of about 56,000 pounds tending to separate the walls 54 and 56 (ignoring the area reduction effected by the reinforcements 82). This separating force on the side walls 54 and 56 is resisted by the top and bottom walls 34 and 50, by front and rear walls 32 and 52, and by the reinforcements 82. As a result, the side walls 54 and 56 are supported to resist bulging of the tank member 30 in the gap 26 between the machines 12 and 14.

Consequently, the tank member 30 is received into the gap 26, and receives water from the spigot 20 via hose 78 to supply this water to the washing machine 12 via hose 80. The water in tank member 30 is refreshed at least in part each time the machine 12 operates so that water flows through the tank member. As this water flow through the tank member 30 takes place, water flows into chamber 30*a* via check valve 64, and exits the tank via tube member 76 and check valve 66. Because the inlet 76*a* to tube member 76 is in basin 50*b*, sediment which might be collected in the tank member 30 is sucked up along with the out-flowing water and exits the tank. Thus, the tank member 30 in use of the device 28 continuously contains a supply of fresh potable water which is frequently refreshed, does not become stagnant, and which does not collect rust scale or other sediments from the domestic water supply.

It is appreciated that the tank member 30 is constructed to resist bulging in response to the internal water pressure, and is generally centered in gap 26 by the ribs 46 and 48 of the tray-like member 42. In the event the user of the device 28 chooses not to use a tray-like member 42, the tank member 30 simply rests in gap 26 between the machines 12 and 14. Even in this case, the tank member 30 at top wall 34 provides top surface 36 which is generally in alignment with the surfaces 38 and 40. Thus, this top surface 36 still provides an effective continuation of the utility surfaces 38 and 40 at the top of the machines 12 and 14. Alternatively, as was alluded to above, the tank member 30 (or an additional tank member connected in water flow series with the tank member in gap 26) may be received in the space 24 behind the washing machine 12. In this case, of course, the tank member 30 in the space 24 will not provide an adjunct to the utility surfaces 38 and 40 at the washer and dryer machines 12 and 14. However, this tank in the space 24 is very unobtrusive, and a tank can be placed in this location even in cramped laundry areas which do not allow enough space for one to be received in the gap 26.

In the event that the emergency supply of water held in tank member 30 is to be used, the user disconnects the hoses 78 and 80, and moves the tank member to a location of use. The tank member may be tipped to allow water to be poured from one of the nipples 60 or 62, or alternatively, a hose (i.e., the hose 78 for example) may be threaded directly to nipple 62 without the check valve assembly 66. This hose in conjunction with tube member 76 allows the user to start a siphon which will withdraw the water from tank member 30. As will be understood in view of the following, the smaller sizes of tanks 30 may be lifted and moved about or tipped to pour out the water. However, larger sizes of the tanks 30 may be too heavy for a user to lift. Alternatively, some users may be too elderly or frail to lift the smaller sizes of the tanks 30.

Figure 2:
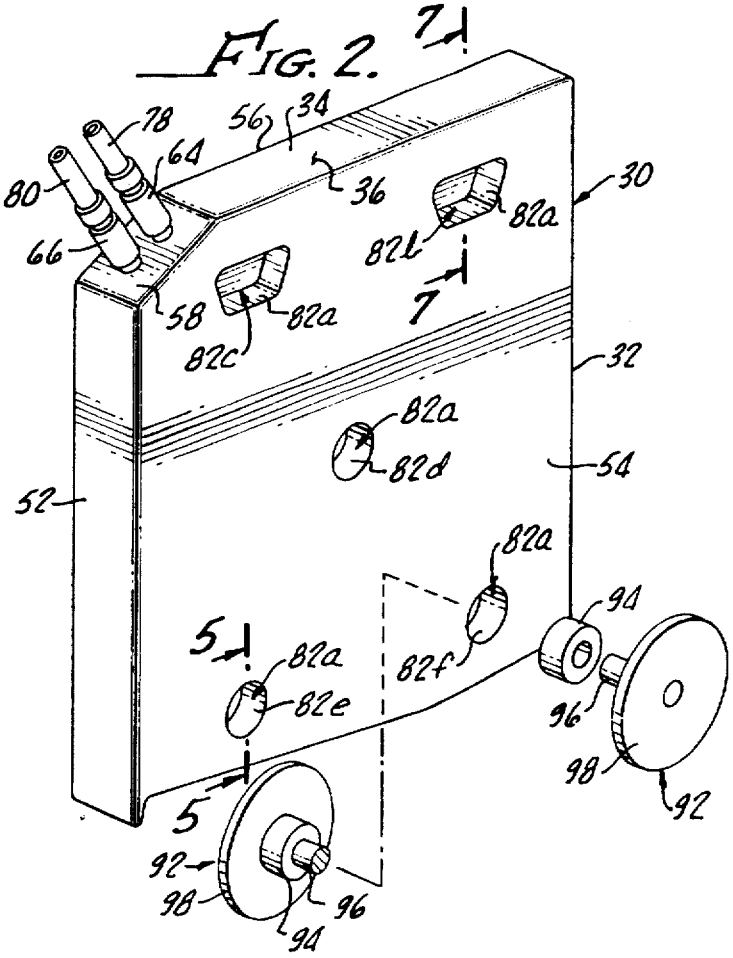

Viewing FIG. 2 an optional alternative embodiment of the tank member 30 is seen in which a wheel and axle kit, generally indicated with the numeral 92, is added to the tank member 30. It will be appreciated that depending on the available space a user has for the tank member, and depending on the emergency water supply needs of a particular residence, the tank members 30 may be manufactured in differing sizes (i.e., differing thicknesses in the direction of width of gap 26). Each inch of thickness of the chamber 30*a* in tank member 30 will store about 3.7 gallons of water. Thus, if the tank members 30 are made in thicknesses of 2, 4, 6, and 8 inches, for example, users may choose to store about 7 and one-half, about 15, about 22, or about 30 gallons of emergency fresh potable water. Of course, these sizes and storage capacities are exemplary only, and other sizes of tank members 30 may be provided. With each size of tank member 30, a tray-like member 42 sized to match with the tank member 30 may be supplied also. For the smaller sizes of these tank members, most users will be able to move the tank member about manually when the water is to be used. That is, the user simply disconnects the hoses 78 and 80 and slides the tank 30 out of the gap 26.

However, the user may not want to or may not be able to lift the tank member 30 at all in order to move it to a location for dispensing the stored water. For example, the 30 gallon size of tank member 30 would weigh about 240 pounds when full of water, and this weight understandably may be more than the user can or wants to lift or slide about. The larger sizes of these tank members 30 would weigh even more. Consequently, the user may choose to install a pair of bushings 94 into the front lower recess **82*f*. In this case, the recess 82*f* would be penetrated through like that shown by dashed lines in FIG. 5. The bushings 94 are sized to be received into the recesses 82*f*, are flanged to engage the opposite side walls 54 and 56 so that they remain spaced apart and support the tank member 30 near these side walls and to journal an axle member 96. On each opposite side of the tank member 30, the axle member 96 carries a respective wheel 98. Because of the location of the recess 82*f* near the front of the tank member 30, the user need only slide the tank forward out of gap 26 a comparatively short distance in order to expose this recess. The user then installs the bushings, axle, and wheels. Once the wheels 98 are in place on axle 96, the tank member 30 may be tipped toward the front wall 32, with the up-curved portion 50*c* of bottom wall 50 providing clearance between this wall and the floor to allow the tank member to be rolled out of gap 26 and to thereafter be rolled about easily on the wheels 98 (i.e., see the phantom floor line and outline of wheel 98 in FIG. 4). During this tipping and rolling of the tank member 30, the recess 82*c*** provides convenient manual purchase on the tank member so that a user is not likely to over exert themselves even with the larger and heavier sizes of tank members.

Figure 8:
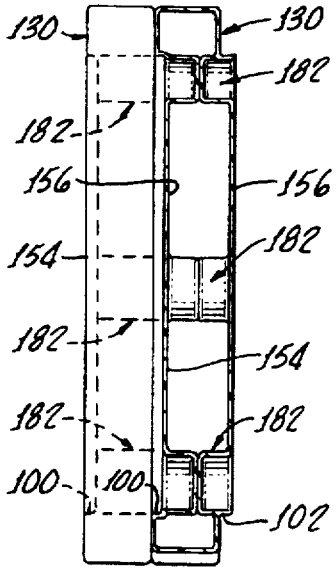

Now viewing FIG. 8, another alternative embodiment of the tank member 30 is shown. In order to obtain reference numerals for use in describing this alternative embodiment of the invention, features which are the same as, or analogous in structure or function to those depicted and described above, are indicated on FIG. 8 with the same numeral used above, and increased by 100. Thus, the tank member in FIG. 8 is indicated with the numeral 130. FIG. 8 shows two tank members 130 nested side by side. Each tank member 130 includes reinforcements 182 extending between side walls 154 and 156. However, in order to allow the tank members to both nest in this side-by-side orientation, and to stack securely one atop another when laid on their sides, the tank members 130 at one side wall 154 or 156 each include a respective recess 100. Preferably, this recess 100 is defined by an inwardly extending peripheral wall portion 102. Dependent upon the locations selected for the reinforcements 182, the wall portion 102 may be a part of or continuous with the wall portion 84 at the upper two reinforcements 82. On the opposite on of the side walls 154 or 156, the tank members 130 each include a protrusion (indicated with arrowed numeral 104, which is sized and configured to nest into the recess 100. Consequently, as is seen in FIG. 8, the tank members 130 will nest with one another when they are setting up in the position indicated by this Figure. In this orientation, the tanks may be nested to allow several tanks to be stored in the gap 26 between machines 12 and 14. However, when tank members of this configuration are to be placed in a location for dispensing the stored water, the user also has the option of stacking the tank members on their sides and nesting them so that they are stacked one atop another. In this orientation of the stacked tank members 130, they may be connected together by use of hoses so that water from all of the stacked tank members is dispensed from a single hose, if desired.

While the present invention has been depicted, described, and is defined by reference to several particularly preferred embodiments of the invention, such reference does not imply a limitation on the invention, and no such limitation is to be inferred. The invention is capable of considerable modification, alteration, and equivalents in form and function, as will occur to those ordinarily skilled in the pertinent arts. The depicted and described preferred embodiments of the invention are exemplary only, and are not exhaustive of the scope of the invention. Consequently, the invention is intended to be limited only by the spirit and scope of the appended claims, giving full cognizance to equivalents in all respects.

I claim:

1. A device for storing an emergency supply of fresh water in association with an automatic washing machine while also providing an adjunct to the horizontal utility surface provided at the top of the automatic washing machine, said device comprising:

a tank member configured to have the form of a thin upright prismatic body defining a chamber therein for holding a supply of fresh water, said tank member including a generally horizontal top wall portion inwardly bounding said chamber and outwardly defining an upper surface oriented to substantially provide an adjunct continuation of the top surface of the washing machine when said tank member is located alongside of the washing machine, said tank member including inflow and outflow means for allowing fresh domestic water to flow from a supply thereof into said tank member chamber and from said tank member chamber to the washing machine;

said tank member defining also a bottom wall portion, a front wall portion, a rear wall portion, and a pair of opposite side wall portions all cooperatively bounding said chamber; each of said pair of side wall portions being of an area much greater than any other wall portion, and at least one reinforcement bridging said chamber and extending between said side wall portions, said reinforcement being stressed in tension by water pressure within said tank portion and supporting said opposite side wall portions against bulging.

2. The device of claim 1 further including a tray-like member configured to nest atop of said tank member and to span a gap defined between the washing machine and an adjacent clothes dryer machine, said tray-like member having an upper surface which forms a continuation of top utility surfaces defined by each of the washing machine and clothes dryer machine, and a pair of spaced apart ridges depending therefrom each to interpose between said tank member and one of the adjacent washing machine and clothes dryer machine.

3. The device of claim 1 wherein said bottom wall portion is configured to form a basin within said chamber, said outflow means including a tube member extending from an inlet thereto adjacent this basin and outwardly of said tank member, whereby out-flowing water sucks any sediment collected in said basin into said tube member and flushes such sediment from said tank.

4. The device of claim 3 wherein said basin is formed by a down sloping portion of said bottom wall extending from said rear wall toward said basin, and a forwardly extending up-curved portion of said bottom wall extending from said basin to said front wall.

5. The device of claim 4 wherein said at least one reinforcement is disposed adjacent to and above said up-curved portion of said bottom wall, said reinforcement having a tubular configuration and providing an aperture extending through said tank member from one opposite side wall to the other.

6. The device of claim 5 further including an axle, bushing, and wheel kit, said kit including a pair of bushing members adapted to be received into said aperture and to journal an axle member of said kit, said axle member being configured to provide opposite end portions disposed on each side of said tank member and to there receive a respective one of a pair of wheels of said kit.

7. The device of claim 6 wherein said wheels are selected to be of a size not touching a floor when said tank member rests upon the floor at said bottom wall, but allowing said tank member to be tipped off said bottom wall so that said forward up-curved portion thereof confronts and is spaced from said floor by engagement therewith of said pair of wheels.

8. The device of claim 1 wherein said tank member further includes a truncated wall portion connecting said top wall portion and said rear wall portion, said inflow and outflow means including said truncated wall portion carrying a pair of nipples one providing for water flow into said chamber and the other providing for water flow from said chamber.

9.The device of claim 8 wherein said bottom wall portion is configured to form a basin within said chamber, said outflow means including a tube member extending from an inlet thereto adjacent this basin and outwardly of said tank member, whereby out-flowing water sucks any sediment collected in said basin into said tube member and flushes such sediment from said tank; and wherein said other nipple is angulated to align along an axis thereof with said basin, said tube member including a tubular body and a flange portion at one end of said tubular body, said tubular body being sized to slip through said other nipple into said tank member chamber with said flange portion engaging onto said other nipple.

10. The device of claim 1 wherein said at least one reinforcement bridging said chamber and extending between said side wall portions includes plural such reinforcements.

11. The device of claim 10 wherein said plural reinforcements includes at least one upper reinforcement which is generally sized and configured to allow manual grasping of the tank member at this location.

12. The device of claim 11 wherein said at least one upper reinforcement has a shape selected from the group consisting of: trapezoidal, round, triangular, oval, and equivalents allowing manual grasping of said tank member at this location.

13. The device of claim 11 wherein said at least one upper reinforcement is located adjacent to a forward side of said tank member.

14. A method of unobtrusively storing an emergency supply of fresh water in a dwelling, said method comprising steps of:

providing a tank member configured to have the form of a thin upright prismatic body defining a chamber therein for holding a supply of fresh water, providing said tank member with inflow and outflow means for allowing fresh domestic water to flow from a supply thereof into said tank member chamber and from said tank member chamber to a washing machine; providing said tank member also with a bottom wall portion, a front wall portion, a rear wall portion, and a pair of opposite side wall portions all cooperatively bounding said chamber; configuring each of said pair of side wall portions to be of an area much greater than any other wall portion, and providing at least one reinforcement bridging said chamber and extending between said side wall portions, stressing said at least one reinforcement in tension by water pressure within said tank portion, and supporting said opposite side wall portions against bulging with said at least one reinforcement.

15. The method of claim 14 further including the step of positioning said tank member along side of a washing machine, and using said top wall of said tank member to provide a continuation of a horizontal utility surface provided by the top of said washing machine.

16. The method of claim 14 further including providing a tray-like member, nesting said tray-like member atop of said tank member and spanning a gap defined between a washing machine and an adjacent clothes dryer machine, providing said tray-like member with an upper surface forming a continuation of top utility surfaces defined by each of the washing machine and clothes dryer machine, and also providing said tray-like member with means for spacing said tank member away from the machines in said gap.

17. The method of claim 16 wherein said step of providing said tray-like member with means for spacing said tank member away from the machines in said gap includes the step of configuring said tray-like member to include a pair of spaced apart ridges depending therefrom each to interpose between said tank member and one of the adjacent washing machine and clothes dryer machine.

18. A device for storing an emergency supply of fresh water in the dwelling while also providing an adjunct to a horizontal utility surface provided at the top of an automatic washing machine, said device comprising:

a tank member configured to have the form of a thin upright prismatic body defining a chamber therein for holding a supply of fresh water, said tank member including a generally horizontal top wall portion inwardly bounding said chamber and outwardly defining an upper surface oriented to provide a continuation of the top surface of the washing machine when said tank member is located along side of the washing machine, said tank member including inflow and outflow means for allowing fresh domestic water to flow from a supply thereof into said tank member chamber and from said tank member chamber to the washing machine;

said tank member defining also a bottom wall portion, a front wall portion, a rear wall portion, and a pair of opposite side wall portions all cooperatively bounding said chamber; each of said pair of side wall portions being of an area much greater than any other wall portion, and at least one reinforcement bridging said chamber and extending between said side wall portions, said reinforcement being stressed in tension by water pressure within said tank portion and supporting said opposite side wall portions against bulging; said bottom wall portion being configured to form a basin within said chamber, said outflow means including a tube member extending from an inlet thereto adjacent this basin and outwardly of said tank member, whereby out-flowing water sucks any sediment collected in said basin into said tube member and flushes such sediment from said tank.

19. The device of claim 18 further including a tray-like member configured to nest atop of said tank member and to span a gap defined between the washing machine and an adjacent clothes dryer machine, said tray-like member having an upper surface which forms a continuation of top utility surfaces defined by each of the washing machine and clothes dryer machine, and a pair of spaced apart ridges depending therefrom each to interpose between said tank member and one of the adjacent washing machine and clothes dryer machine.

20. The device of claim 18 wherein said tank member further includes a wall portion carrying a pair of nipples, one of said pair of nipples providing for water flow into said chamber and the other providing for water flow from said chamber and carrying said tube member, and a pair of check valve assemblies one connecting respectively to each of said pair of nipples, one of said pair of check valve assemblies providing for water flow only inwardly of said chamber, and the other of said pair of check valve assemblies providing for water flow only outwardly of said chamber.

* * * * *